US009562343B2

(12) United States Patent
Paull

(10) Patent No.: US 9,562,343 B2
(45) Date of Patent: Feb. 7, 2017

(54) CABLE-LAYING PLOW ATTACHMENT FOR A BACKHOE AND METHOD FOR USING THE SAME

(71) Applicant: Philip Paull, Nobelsville, IN (US)

(72) Inventor: Philip Paull, Nobelsville, IN (US)

( * ) Notice: Subject to any disclaimer, the term of this patent is extended or adjusted under 35 U.S.C. 154(b) by 78 days.

(21) Appl. No.: 14/514,899

(22) Filed: Oct. 15, 2014

(65) Prior Publication Data

US 2015/0101217 A1 Apr. 16, 2015

Related U.S. Application Data

(60) Provisional application No. 61/891,576, filed on Oct. 16, 2013.

(51) Int. Cl.

| | |
|---|---|
| ***E02F 5/02*** | (2006.01) |
| ***E02F 3/96*** | (2006.01) |
| ***E02F 5/10*** | (2006.01) |

(52) U.S. Cl.

CPC ..... *E02F 5/027* (2013.01); *E02F 3/962* (2013.01); *E02F 5/10* (2013.01)

(58) Field of Classification Search

CPC ..... E02F 5/102; E02F 5/104; E02F 5/106; E02F 5/02; E02F 5/12; E02F 5/027; E02F 5/10; E02F 3/962; H02G 1/06; H02G 1/10

See application file for complete search history.

(56) References Cited

U.S. PATENT DOCUMENTS

| | | | | |
|---|---|---|---|---|
| 2,042,196 | A | 5/1936 | Senz | |
| 2,416,409 | A | 2/1947 | Schield | |
| 2,783,558 | A | 3/1957 | Morgan | |
| 2,899,760 | A | 8/1959 | Armington et al. | |
| 2,993,285 | A | 7/1961 | Hoxie | |
| 3,065,557 | A | 11/1962 | Pewthers | |
| 3,113,390 | A | 12/1963 | Pewthers | |
| 3,238,648 | A | 3/1966 | Cobb et al. | |
| 3,305,951 | A | 2/1967 | Nunn | |
| 3,664,137 | A | 5/1972 | Lett | |
| 3,820,345 | A | 6/1974 | Brecht | |
| 4,133,121 | A | 1/1979 | Hemphill | |
| 4,289,424 | A | 9/1981 | Shefbuch et al. | |
| 4,322,178 | A | 3/1982 | Lee | |
| 4,362,435 | A | 12/1982 | Henry | |
| 4,363,594 | A | 12/1982 | Morin | |
| 4,485,877 | A | 12/1984 | McMillan | |
| 4,512,090 | A | 4/1985 | Billings | |
| 4,539,765 | A * | 9/1985 | Reece | E02F 5/102 172/393 |
| 4,625,438 | A | 12/1986 | Mozer | |

(Continued)

*Primary Examiner* — Jamie L McGowan

(74) *Attorney, Agent, or Firm* — C. John Brannon; Brannon Sowers & Cracraft PC

(57) ABSTRACT

A plow attachment for an excavator, including a distal portion having elongated curved front and rear walls, and an elongated top wall, a pair of oppositely disposed elongated hook-shaped side walls connected to the top, front and rear walls and defining an elongated trough, a soil-deflecting wedge portion extending from between the sidewall portions and positioned opposite the top wall member. The plow attachment includes a proximal portion connected to the distal portion and having a flat skid plate member, a structural member connected to the flat plate member, and a hoe connecting member connected to the structural member.

9 Claims, 4 Drawing Sheets

(56) References Cited

U.S. PATENT DOCUMENTS

| | | | | | |
|---|---|---|---|---|---|
| 4,655,639 | A * | 4/1987 | Reece | E02F 5/106 | 37/367 |
| 4,676,319 | A | 6/1987 | Cuthbertson | | |
| 4,719,711 | A | 1/1988 | Sieber et al. | | |
| 4,741,646 | A | 5/1988 | Hatch | | |
| 4,759,138 | A * | 7/1988 | Grinsted | E02F 5/104 | 37/195 |
| 4,802,793 | A * | 2/1989 | Grinsted | E02F 5/104 | 405/159 |
| 4,896,998 | A * | 1/1990 | Reece | E02F 5/102 | 405/160 |
| 4,903,418 | A | 2/1990 | Loudon | | |
| RE33,198 | E | 4/1990 | Ballinger | | |
| 4,967,850 | A | 11/1990 | Bargfrede et al. | | |
| 4,981,396 | A | 1/1991 | Albertson et al. | | |
| 5,145,290 | A | 9/1992 | Wise | | |
| 5,174,685 | A | 12/1992 | Buchanan | | |
| 5,212,897 | A * | 5/1993 | Jefferson | E02F 3/962 | 37/379 |
| 5,253,449 | A | 10/1993 | Webb et al. | | |
| 5,253,716 | A | 10/1993 | Mitchell | | |
| 5,273,375 | A | 12/1993 | Plourde | | |
| 5,462,389 | A * | 10/1995 | Messina | E02F 5/104 | 172/700 |
| 5,558,465 | A * | 9/1996 | Pecot | E02F 5/102 | 254/134.4 |
| 5,707,175 | A | 1/1998 | Geelhoed | | |
| 5,727,387 | A | 3/1998 | Hosseini et al. | | |
| 5,806,607 | A | 9/1998 | Sanders | | |
| 5,833,008 | A | 11/1998 | Reed et al. | | |
| 5,901,479 | A | 5/1999 | Langdon | | |
| 5,988,948 | A * | 11/1999 | Featherstone | E02F 5/102 | 37/409 |
| 6,032,093 | A | 2/2000 | Denbraber et al. | | |
| 6,067,733 | A | 5/2000 | Gasper | | |
| 6,434,863 | B1 | 8/2002 | Meurer | | |
| 6,435,772 | B1 * | 8/2002 | Reece | E02F 5/102 | 405/158 |
| 6,447,204 | B1 | 9/2002 | McDonald | | |
| 6,460,276 | B1 | 10/2002 | Ireland | | |
| 6,530,721 | B2 | 3/2003 | Yost | | |
| 6,578,297 | B1 | 6/2003 | Forsberg | | |
| 6,729,796 | B1 | 5/2004 | Green | | |
| 6,736,216 | B2 | 5/2004 | Savard et al. | | |
| 6,840,330 | B2 | 1/2005 | Lancaster | | |
| 6,865,464 | B2 | 3/2005 | Colburn | | |
| 6,928,758 | B1 | 8/2005 | Stout | | |
| 6,990,390 | B2 | 1/2006 | Groth et al. | | |
| 6,990,690 | B2 | 1/2006 | Gait | | |
| 7,101,116 | B2 * | 9/2006 | Hart | E02F 5/003 | 405/158 |
| 7,311,466 | B2 | 12/2007 | Torvinen | | |
| 7,506,462 | B2 | 3/2009 | Reid | | |
| 7,532,967 | B2 | 5/2009 | Fujishima et al. | | |
| 7,581,340 | B2 | 9/2009 | Wolfe | | |
| 7,891,121 | B2 | 2/2011 | Smoljo | | |
| 8,437,921 | B2 | 5/2013 | Paull | | |
| 2002/0071724 | A1 * | 6/2002 | Reece | E02F 5/102 | 405/159 |
| 2002/0100192 | A1 * | 8/2002 | Kenkel | E02F 5/102 | 37/367 |
| 2002/0179307 | A1 | 12/2002 | Schmidt et al. | | |
| 2005/0074293 | A1 * | 4/2005 | Searby | E02F 5/08 | 405/180 |
| 2005/0199402 | A1 | 9/2005 | Moses | | |
| 2006/0021764 | A1 | 2/2006 | Archer et al. | | |
| 2006/0056917 | A1 * | 3/2006 | McCormick | E02F 5/101 | 405/116 |
| 2007/0205005 | A1 | 9/2007 | Peltola et al. | | |
| 2007/0286681 | A1 * | 12/2007 | Parent | E02F 5/101 | 405/174 |
| 2010/0310320 | A1 * | 12/2010 | Kluge | E02F 5/101 | 405/178 |
| 2011/0142544 | A1 * | 6/2011 | Michaelis | E02F 5/101 | 405/182 |
| 2014/0150303 | A1 * | 6/2014 | Wilson | E02F 5/027 | 37/342 |
| 2014/0154014 | A1 * | 6/2014 | Wilson | H02G 1/10 | 405/159 |

* cited by examiner

CABLE-LAYING PLOW ATTACHMENT FOR A BACKHOE AND METHOD FOR USING THE SAME

CROSS-REFERENCE TO RELATED APPLICATIONS

This application claims priority to U.S. provisional patent application Ser. No. 61/891,576, filed on Oct. 16, 2013.

TECHNICAL FIELD

The present novel technology relates generally to the field of mechanical engineering, and, more particularly, to an apparatus for enabling a backhoe to plow a furrow while laying flexible pipe or cable and a method for using the same.

BACKGROUND

The backhoe is one of the most versatile digging tools available. Backhoes can be maneuvered into position in places to dig where other excavation machines cannot go. The digging apparatus of the backhoe includes a hinged and hydraulically driven armature to which a generally semicircular bucket is hingedly connected. Backhoe buckets tend to be about 2 feet wide and connect to the manipulating armature at a like-sized connection plate. This means that ditches and trenches dug with a backhoe have a minimum width of about 2 feet, and the soil is removed one bucketload at a time.

There are many situations calling for the deposition of cable or flexible pipe in narrow trenches that a backhoe equipped with a conventional bucket or even a modified bucket just can't address. These trenches must be dug by other means. There are specialized excavation machines designed for laying pipe or cable in narrow trenches. While these tools accomplish the task of digging narrow trenches for the deposition of cable thereinto, they are expensive, prone to frequent breakdown, and their use necessitates the purchase or rental of specialized equipment by the contractor, often for one relatively short dig.

Thus, there is a need for an apparatus that would take advantage of the versatility of a backhoe system for digging narrow furrows for the deposition of pipe or cable. The present novel technology addresses this need.

SUMMARY

The present novel technology relates to a method and apparatus for digging narrow trenches and simultaneously laying pipe or cable with a backhoe. One object of the present novel technology is to provide an improved backhoe plow system for digging narrow furrows while simultaneously laying pipe and/or cable. Related objects and advantages of the present novel technology will be apparent from the following description.

DETAILED DESCRIPTION OF THE PREFERRED EMBODIMENT

Figure 1:
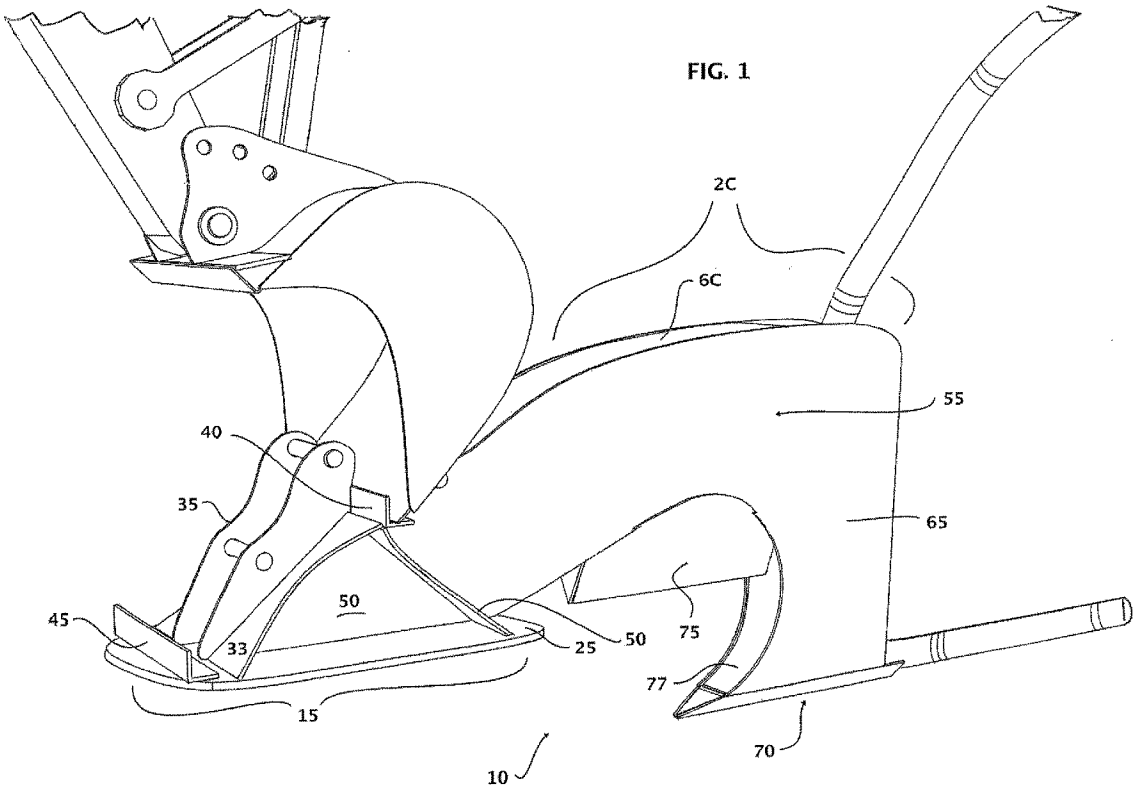
FIG. 1 is a perspective view of a first embodiment of the present novel technology, an elongated plow attachment for digging relatively deep and narrow trenches with a backhoe.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A typical backhoe, trackhoe or like excavator includes a hinged armature or boom having a connection plate or assembly at the distal end. The connection assembly typically includes one or more connection members and a set of pins for engaging a bucket therewith. The connection members and pins are typically more than 12 inches long. The bucket is typically generally semicircular or semi-ovoid in shape. For semi-ovoid buckets, the short axis is the bisector. Buckets are designed to scoop out and retain a maximum load of dirt, gravel or the like. The backhoe operates by driving the teeth or leading edge of the bucket into the dirt or other medium to be excavated or moved, driving the bucket forward to fill it, pivoting the bucket into a mouth-up position, lifting the bucket out of the excavation, pivoting the armature away from the excavation, pivoting the bucket into a mouth-down position, emptying the bucket, pivoting the armature back to the excavation, and repeating the process. The minimum width of an excavation is the width of the pins and connection members and/or the armature, and, for smaller buckets, the maximum depth is the bucket height.

Figure 2:
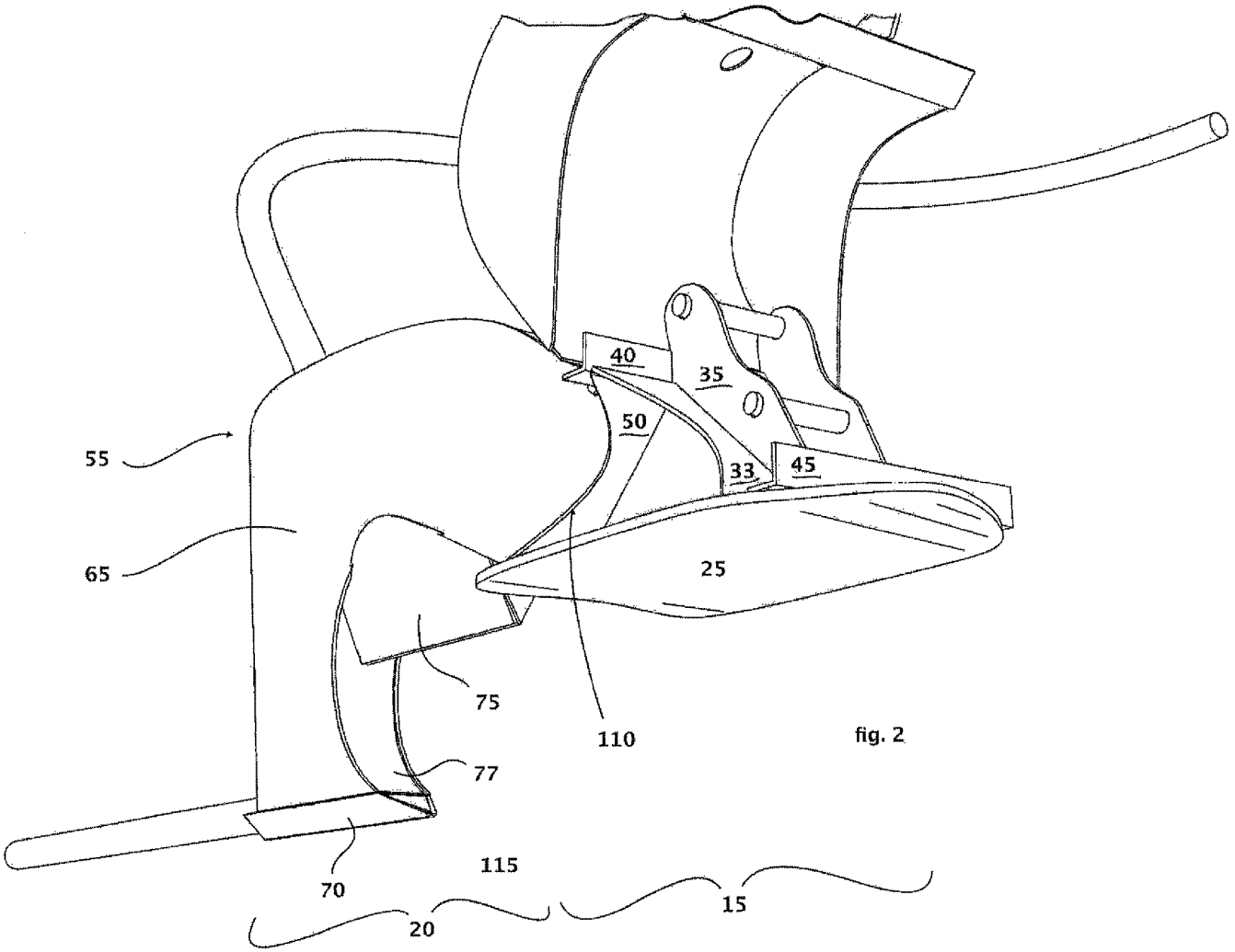
FIG. 2 is a second perspective view of the plow attachment of FIG. 1 as connected to a backhoe.
Figure 3:
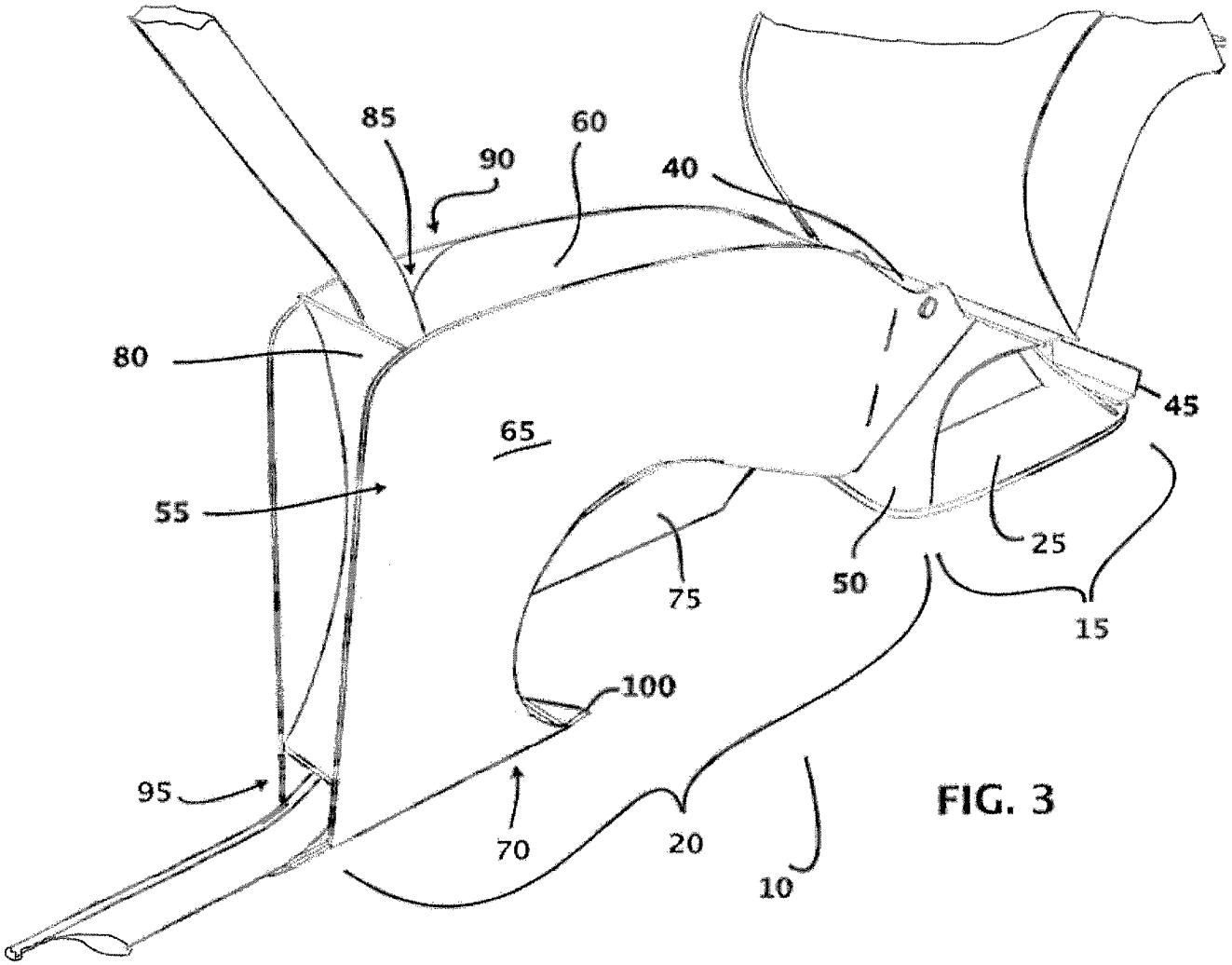
FIG. 3 is third perspective view of the plow attachment of FIG. 1 as connected to a backhoe.
Figure 4:
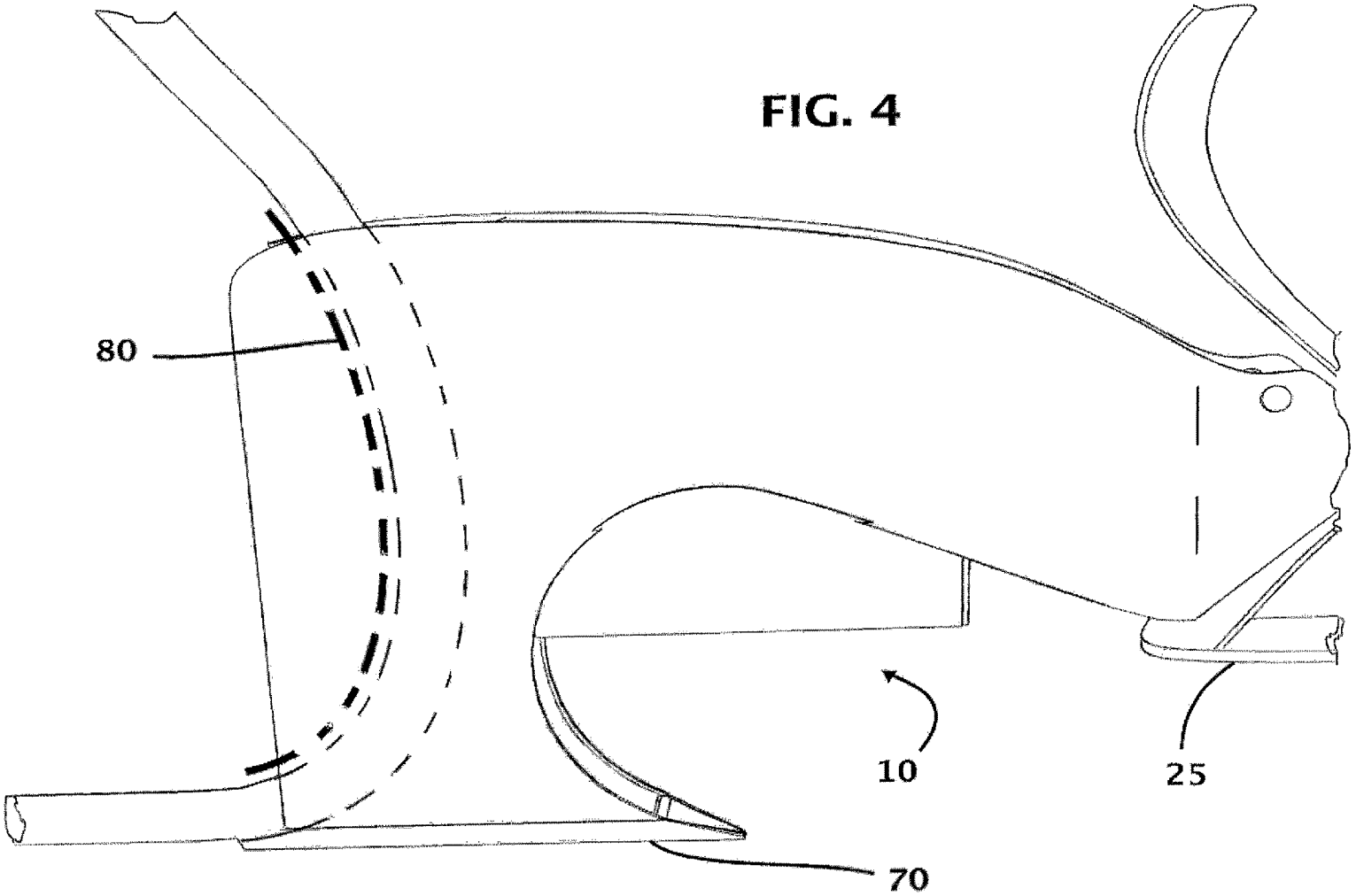
FIG. 4 is a fourth perspective view of the plow of FIG. 1.

The present novel technology allows for the plowing of relatively narrow furrows or trenches with a backhoe, and also for a much faster, more efficient pipe and/or cable deposition technique. A first embodiment of the present novel technology is illustrated in FIGS. 1-5, a backhoe plow attachment system 10 for digging relatively narrow (typically between about 6-8 inches wide and about 18 inches wide) trenches. The attachment 10 system includes a proximal portion 15 and a generally elongated distal portion 20. The proximal portion 15 further includes a generally flat skid plate member 25 with a typically generally wedge-shaped or triangularly-shaped structural member or portion 30 connected to one face or side thereof. The wedge-shaped structural portion 30 is typically connected to a first or proximal face or plate member 33 to which a coupler 35 is connected. At either end of the coupler 35, first and second elongated angle irons 40, 45 are connected to the proximal portion 15, typically to the first face member 33 and/or to the flat skid plate member 25, and are oriented to engage the lip of a bucket moving from the direction of the distal portion 20. Structural member 30 is also typically connected to a second or distal plate or face 50 member positioned to engage the elongated distal portion 20. Members 25, 33 and 50 are typically connected to structural member 30 to define a proximal portion 15 having a triangular cross-section.

Elongated distal portion 20 includes an elongated, generally hook-shaped, J-shaped and/or 7-shaped body member 55. The body member 55 includes a top member 60, a pair of oppositely disposed side members 65, and terminates in a plow wedge 70. Elongated distal body member 55 further includes front member 77 and a curved rear member 80 positioned between side members 65. The space between the curved rear member 80, the top member 60, and the front member 77 defines a curved passageway or trough 85, including an upper entry aperture 90 and a lower exit aperture 95, through which cable and/or flexible pipe may be threaded.

Distal portion further includes a secondary wedge member 75 positioned between the side members 65 and protruding downwardly (or in a direction opposite the top member 60). Bottom plow wedge 70 includes a leading knife-edge or point 100 and a wedge-shaped bottom member 105 connected to the point 100, sidewalls 65 and front wall 77. Front and rear curved members 77, 80 are both convex relative to one another or concave relative to the outside of the device 10. The intersection of the distal portion 20 and the proximal portion 15 defines a distal portion first end 110, and the wedge-shaped bottom member 105 is positioned at the opposite distal portion second end 115.

In operation, the plow attachment 10 is operationally connected to the boom or digging armature of the backhoe either by direct connection to the coupler 35 or by engaging a bucket to a connector 40, 45. Cable or pipe is threaded through the entry aperture 85, through the trough 90, and out the exit aperture 95. The distal portion 20 is inserted into a pre-dug starter hole and is pulled or dragged by the boom arm through the ground, or, alternately, the wedge 70 is forceably engaged with the earth to begin a furrow. The plow 10 is brought forward (toward the backhoe), typically while downward pressure is applied. Earth is dislodged and forced up the curved front wall 77 and into wedge 75, where it is directed up and out of the furrow. Pipe and/or cable is fed through the trough 85 and laid in the as-dug trench. The excavated soil may be replaced, burying the pipe and/or cable.

The attachment 10 may be attached directly to a hoe boom arm via coupler 35. When so attached, the plow 10 becomes part of the overall backhoe system, and may be controlled via whatever control paradigm is used as part of that system. For instance, if the backhoe used GPS location and a computer-driven automated control system, the hoe attachment simply replaces the bucket to become end portion of the boom arm being controlled. Such a system may be programmed to move and position the plow 10 in the same way that it is programmed to move and position a bucket.

In operation, a hoe may be engaged with the system 10 to simultaneously dig a narrow trench and lay cable therein. First, the skid portion 15 is engaged with a boom arm, such as from a back hoe, track hoe, or the like, wherein the skid portion 15 is operationally connected to a trailing generally J-shaped trench-digging portion 20, wherein the skid portion 15 further comprises a flat, ground-engaging skid plate 25 and wherein the J-shaped trench-digging portion 20 further comprises a ground-engaging digging point 79, a curved soil-directing wall portion 77, a soil-directing wedge portion 79, and a cable directing trough portion 85. The skid portion 15 is urged along a cable burial route, while a downward force is applied thereto. The digging point 79 penetrates soil along the cable burial route to a predetermined depth to define a trench. Soil is urged from the trench along the curved soil-directing wall portion 77, into the soil-directing wedge portion 75, and onto surface ground. Cable is directed the trough 85 and into the trench. The displaced soil may then be at least partially refilled into the trench.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A plow attachment for an excavator, comprising:

a distal portion, further comprising:

an elongated curved rear wall defining a first wedge portion for engaging and directing ground soil to yield a trench;

an elongated curved front wall;

an elongated top wall member;

a pair of oppositely disposed elongated hook-shaped side walls connected to the top, front and rear walls and defining an elongated trough;

a soil-deflecting second wedge portion spaced from the first wedge portion and extending from between the sidewall portions and positioned opposite the top wall member; and a proximal portion connected to the distal portion and further comprising:

a flat skid plate member;

a structural member connected to the flat plate member; and a hoe connecting member connected to the structural member for engaging a hoe bucket to push the plow attachment forward and downward to yield a trench;

wherein the skid plate member limits depth of cut of the plow attachment; and wherein the soil-deflecting wedge is positioned to engage soil urged through the trough by the elongated curved rear wall for deflection out of the trench.

2. The plow attachment of claim 1 and further comprising:

a first connection plate operationally connected to and joining the structural member and the distal portion.

3. The plow attachment of claim 2 and further comprising:

a second connection plate operationally connected to the structural member; and a coupler connected to the second connection plate.

4. The plow attachment of claim 2 and further comprising:

wherein the elongated curved rear wall and the pair of oppositely disposed side walls define the cable trough positioned opposite the soil-deflecting wedge portion.

5. The plow attachment of claim 1 and further comprising:

a first connection plate operationally connected to and joining the structural member and the distal portion;

a second connection plate operationally connected to the structural member; and a coupler connected to the second connection plate;

wherein the elongated curved rear wall and the pair of oppositely disposed side walls define the cable trough positioned opposite the soil-deflecting wedge portion.

6. An elongated plow attachment for an excavator, comprising:

a recessed J-shaped elongated portion having a proximal end and a distal end, wherein the distal end defines a plow wedge;

a skid portion member connected at the proximal end of the recessed J-shaped elongated portion; and a trough formed through the recessed J-shaped elongated portion through which cable may be threaded;

wherein the recessed J-shaped elongated portion further comprises:

an elongated curved soil-directing distal wall;

an elongated curved proximal wall;

an elongated top wall;

a pair of oppositely disposed elongated hook-shaped side walls connected to the top, proximal and distal walls and defining an elongated trough; and a second, separate wedge connected to and positioned between the pair of oppositely disposed elongated hook-shaped sidewalls and extending away from the elongated top wall for receiving soil directed from the elongated curved soil-directing distal wall and deflecting said soil away from the plow attachment; and wherein the skid portion further comprises:

a structural member connected to the proximal end;

a coupler connected to the structural member; and a flat skid member connected to the structural member; and a hoe bucket-engaging member connected to the skid portion for engaging a hoe bucket to push the plow attachment forward and downward to yield a trench wherein the elongated curved distal wall, the elongated curved proximal wall and the elongated top wall define the trough through which cable may be threaded.

7. The elongated plow attachment for an excavator of claim 6, and further comprising:

a first connection plate operationally connected to and joining the recessed J-shaped elongated portion and the skid portion;

a second connection plate operationally connected to and joining the structural member and the coupler.

8. A method for using a hoe to simultaneously dig a narrow trench and lay cable therein, comprising:

a) engaging a skid portion with a boom arm, wherein the skid portion is operationally connected to a trailing generally J-shaped trench-digging portion, wherein the skid portion further comprises a flat, ground-engaging skid plate and wherein the J-shaped trench-digging portion further comprises a ground-engaging digging first wedge portion, a curved soil-directing wall portion, a soil-directing second wedge portion spaced from the first wedge portion, and a cable directing trough portion;

b) urging the skid portion along a cable burial route while applying a downward force thereto;

c) penetrating soil along the cable burial route with the digging point to a predetermined depth to define a trench;

d) urging soil from the trench along the curved soil-directing wall portion, into the soil-directing second wedge portion, and onto surface ground;

e) directing cable through the trough and into the trench.

9. The method of claim 8 and further comprising:

f) replacing soil back into the trench.

* * * * *